United States Patent [19]

Schroeder

[11] Patent Number: 4,739,988

[45] **Date of Patent: * Apr. 26, 1988**

[54] YIELDABLE DIRECT MOUNT BELOW THE BACKBOARD GOAL SYSTEM

[75] Inventor: Edward A. Schroeder, Algonquin, Ill.

[73] Assignee: Porter Equipment Company, Schiller Park, Ill.

[ * ] Notice: The portion of the term of this patent subsequent to Mar. 17, 2004 has been disclaimed.

[21] Appl. No.: 919,380

[22] Filed: Oct. 16, 1986

Related U.S. Application Data

[63] Continuation-in-part of Ser. No. 828,899, Feb. 13, 1986, Pat. No. 4,650,188.

[51] Int. Cl.[4] ..... A63B 63/08

[52] U.S. Cl. ..... 273/1.5 R

[58] Field of Search ..... 273/1.5 R, 1.5 A

[56] References Cited

U.S. PATENT DOCUMENTS

| | | | |
|---|---|---|---|
| 2,254,507 | 9/1941 | Albach et al. . | |
| 2,363,634 | 11/1944 | Albach et al. . | |
| 2,786,678 | 3/1957 | Fink . | |
| 3,017,183 | 1/1962 | Chalcroft . | |
| 3,018,102 | 1/1962 | Murphy . | |
| 3,462,143 | 8/1969 | Bidelman et al. . | |
| 3,970,304 | 7/1976 | Ebstein et al. . | |
| 4,082,269 | 6/1977 | Hill | 273/1.5 R |
| 4,145,044 | 3/1979 | Wilson et al. . | |
| 4,285,518 | 8/1981 | Pearo . | |
| 4,348,022 | 9/1982 | O'Donnell | 273/1.5 R |
| 4,433,839 | 2/1984 | Simonseth . | |
| 4,438,923 | 3/1984 | Engle et al. | 273/1.5 R |
| 4,534,556 | 8/1985 | Estlund et al. | 273/1.5 R |
| 4,588,188 | 5/1986 | Mahoney et al. . | |
| 4,650,188 | 3/1987 | Schroeder | 273/1.5 R |

OTHER PUBLICATIONS

Adams Plastics, Inc., Circular 1/1980 Basketball Backboard Bumpers, No. 1800.

Slam Dunk Rim, Inc., Circular 3—Adaptable Springs.

*Primary Examiner*—Paul E. Shapiro

*Attorney, Agent, or Firm*—Barnes & Thornburg

[57] ABSTRACT

A goal having a horizontal bracket extending below and behind a backboard is yieldably mounted at two longitudinally spaced positions to a rearly extending brace attached to the backboard frame.

13 Claims, 4 Drawing Sheets

YIELDABLE DIRECT MOUNT BELOW THE BACKBOARD GOAL SYSTEM

This application is a continuation-in-part of U.S. patent Ser. No. 828,899 filed Feb. 13, 1986 U.S. Pat. No. 4,650,188.

BACKGROUND AND SUMMARY OF THE INVENTION

The present invention relates generally to basketball systems and more specifically to an improved method of mounting yieldable goals and backboards to the support structure.

A standard glass backboard generally includes a glass with a frame therearound. The frame generally includes brackets for mounting of the frame to a support structure. A pair of plates are provided on the front and back of the glass with four pre-drilled apertures and connectors through the backboard between the two plates to allow mounting of a goal to the two plates. With the advent of the "dunk shot", further protection for the glass was needed. In addition to a breakaway or yieldable goal structure, the prior art also attempted to transfer the forces to torsion bars connected to the support structure. The system illustrated in U.S. Pat. No. 4,433,839 to Simonseth is an example.

Another method, which has been used but has been abandoned, is to diminish the height of the backboard and connect the goal beneath the reduced bottom edge of the backboard to a torsion bar at the rear of the board. This is illustrated in U.S. Pat. No. 3,462,143. Although removing the drilled holes which weaken the glass, this system had other problems. The connection of the goal to the torsion bar is along a welded horizontal line. This produces a cantilever affect at a point along a single line, thereby creating substantial stress and moments. In use, this goal attachment structure flexed unacceptably, acting as a torsion system and moved relative to this backboard. Thus, this system was abandoned by the industry.

Even through direct mounting of the goal to the support structure has protected the glass backboard, it has not protected the player. The motion of the players' body downward engages a stationary hoop structure and is equivalent to an automobile hitting a brick wall. The weaker of the two elements at impact must absorb the forces. This is generally the player, resulting in jammed or broken limbs.

Thus, there exists a need for providing an improved mounting of a goal yieldably to the backboard support structure.

Another object of the present invention is to provide a mounting of a goal to the backboard support structure without the Problems of the prior art.

Still another object of the present invention is to provide a direct mount system requiring no holes in the glass backboard.

An even further object of the present invention is to provide a direct mount system which protects the player.

These and other objects of the invention are attained by extending the depth of the back bottom portion of the backboard frame and securing the goal to the backboard frame and extended backboard frame along at least two longitudinally spaced positions. This structure alleviates the point or single line of cantilevered construction and distributes the cantilever load over a greater longitudinal distance of the cantilever structure.

In one embodiment, the depth of the frame is increased by providing a vertical brace extending between and secured to the top and bottom of the frame and centered thereon to restrict flexing of the backboard. A horizontal flange is provided on the vertical brace and the goal is mounted to the flange as well as to the frame. In another embodiment, wherein the support is a vertical post centered on the backboard, the bottom rear portion of the frame is extended by a horizontal brace extending substantially along the length thereof and includes a portion extending to the post clamp. The rim is connected to the rear extension in at least two longitudinally spaced positions. In an even further embodiment, for a horizontal center support structure, a horizontal brace extends the rear portion of the frame and the goal is secured to the horizontal brace and the centered horizontal strut.

The two positions of attachment include two pairs of longitudinally spaced apertures. A fifth aperture is provided for securing the goal to the existing frame of the backboard. The goal is a unique structure having a tubular extension or support bracket in which the apertures are provided to align with the apertures in the frame, brace or other structure. The frame of the backboard has padding along the front and side edges of the bottom and side portions and the tubular extension of the goal has padding along its side and bottom surfaces.

The goal may be yieldably mounted to the brace extending from the frame so as to yield in response to excess force and protect the player. Fasteners are provided at the two positions of attachment extending between the brace and the tubular extension of the goal. A resilient device is provided on the fasteners. The resilient device may be an elastomer or metal leaf spring. A common resilient device may be used with all the fasteners at all the positions. The resilient device may be provided interior the tubular extension of the goal or exterior thereof. The tubular extension has a generally rigid U-shaped cross section with padding extending across the open end of the U-shaped and along the outside of the legs of the U-shape. Alternatively, a hinge may be provided at one of the longitudinal spaced position for and the fastener and resilient devices at the other longitudinal position.

Other objects, advantages and novel features of the present invention will become apparent from the following detailed description of the invention when considered in conjunction with the accompanying drawings.

DETAILED DESCRIPTION OF THE DRAWINGS

Figure 1:
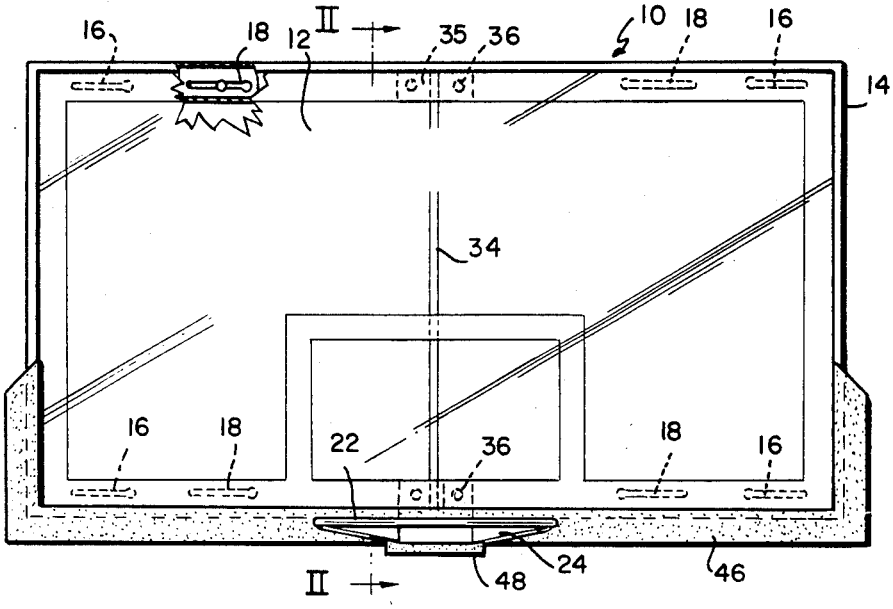
FIG. 1 is a front view of the basketball backboard system having a vertical brace incorporating the principles of the present invention.
Figure 2:
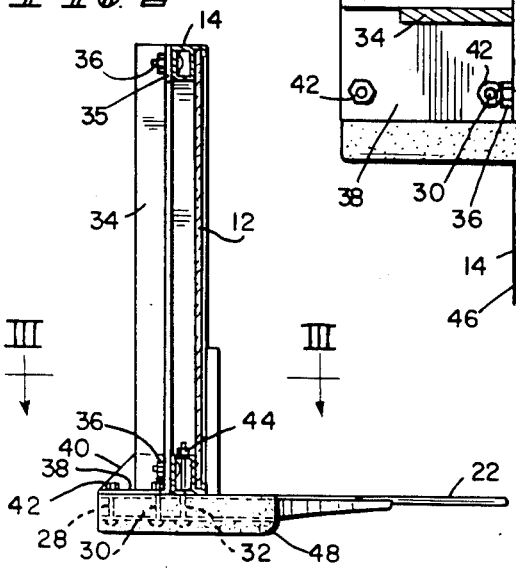
FIG. 2 is a cross-section taken along lines II-II of FIG. 1.
Figure 3:
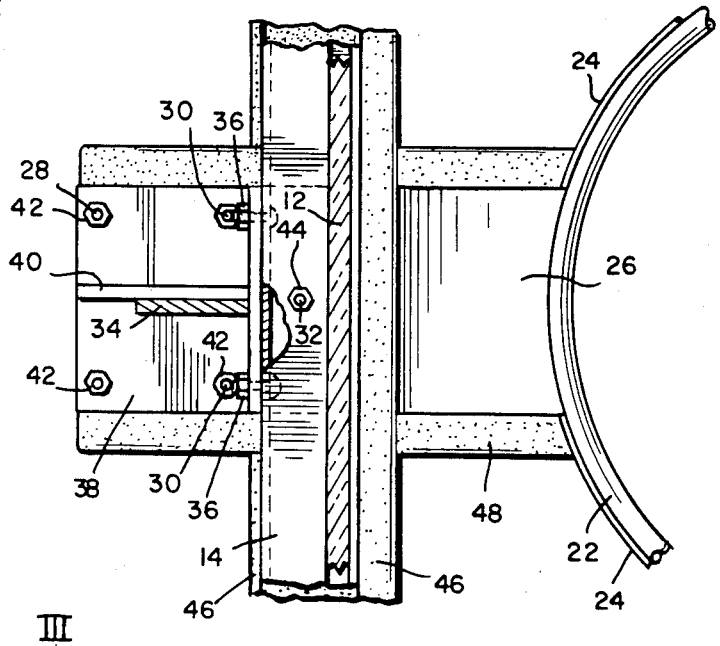
FIG. 3 is a plan cross-sectional view taken along lines III—III of FIG. 2.

A backboard assembly 10 as illustrated in FIGS 1–3 include a glass bank 12 surrounded by flange 13 of a tubular frame 14. Keyhole slots 16, 18 and 20 are provided in the top and bottom rear walls of the tubular frame 14 to allow attachments of the support structure. Where a standard glass backboard has a general dimensions of the height of 4 feet and a length of 6 feet, the backboard of the present invention has a height of 3 feet and a length of 5 feet, 6 inches. The center-to-center distance of keyhole slots 16 is 4 feet, 6 inches and that of keyholes 18 is 2 feet, 11 inches. With the outside dimension of 5 feet, 6 inches, the board will mount to standard pre-existing ceiling suspended drop frames using slot 18.d The tubular frame 14 adds rigidity to the backboard and the versatility of mounting structure. In the prior art, mounting plates were welded to the frame.

By shortening the height of the backboard and removing substantially non-playable areas, the goal of the goal may be mounted directly to the support structure without passing through or being supported on the glass bank 12. Thus, the holes in the glass which weaken it are eliminated.

The goal includes a closed ring 22 with downward extending circumferal flanges 24 along the sides and back thereof. A rectangular cross-section support bracket 26 extends from the back of the ring 22. The length of bracket 26 along its extending longitudinal axis is sufficient to traverse the bottom edge of the frame 14 and extends therepast to provide securing to a support structure at two longitudinally spaced positions. As illustrated in FIG. 3, a pair of apertures 28 in the support bracket 26 define one position, while a pair of apertures 30 define a second position. A fifth aperture 32 is provided and longitudinally spaced from the other two pairs of apertures. As will be discussed more fully below, whereas apertures 28 and 30 are connected to the extended frame or support structure, aperture 32 aligns with and is secured to the frame 14 of the backboard 12.

The brace which secures the support bracket 26 of the goal to the frame 14 of the backboard 12, in the FIGS. 1–3 embodiment, includes a vertical brace 34 having a top plate 35 and an L-shaped bottom flange or gusset 38 welded thereto. The brace is secured to the top and bottom of the frame 14 by fasteners 36 in top plate 35, bottom flange 38 and keyhole slots 20. The brace 34 should be as thin as is practical to minimize its appearance through the glass backboard. At the bottom of brace 34 is a flange or plate 38 welded thereto. A triangular-shaped flange 40 is welded between the brace 34 and the flange 38. Fasteners 42 extend through apertures 28 and 30 in the support bracket 26 of the goal and corresponding apertures in the plate 40 to secure the goal to the flange 38 and brace 34. Fastener 44 extends through aperture 32 in the support bracket 26 and into a corresponding apertures in frame 14 of the backboard.

Thus, it can be seen that the brace 34 and the flange 38 extend the rear back surface of the backboard frame 14 and permits the mounting of the goal via its support bracket 26 at two longitudinally displaced positions. This distributes the forces of the cantilevered goal from a single line of contact and thereby reduces the deformation of the support bracket 36 and its movement relative to the frame 14 and the glass 12. The rectangular cross-section or the tubular shape of the support bracket 26 also increases its rigidity and its ability to carry the cantilevered load. During tests, it has been found that upon loading the front of the rim, that the rim 22 deformed at approximately an 800 pound load with no deformation or movement of the support bracket 26 relative to the backboard or frame up to the tested 2,000 pound load. The tubular frame 14 and the vertical brace 34 attached to the frame at the top and bottom in the center reduce the bowing of the glass backboard and thereby reduces stress in the glass. The front and side surfaces of the bottom and adjacent portions of the sides of the frame 14 are covered with the industry standard two inch thick padding 46. The support bracket 26 of the goal is also surrounded by a one inch thick padding 48. The padding on the goal maximize players' protection from sharp edges and from the fasteners used to mount the goal to the support structure.

Figure 4:
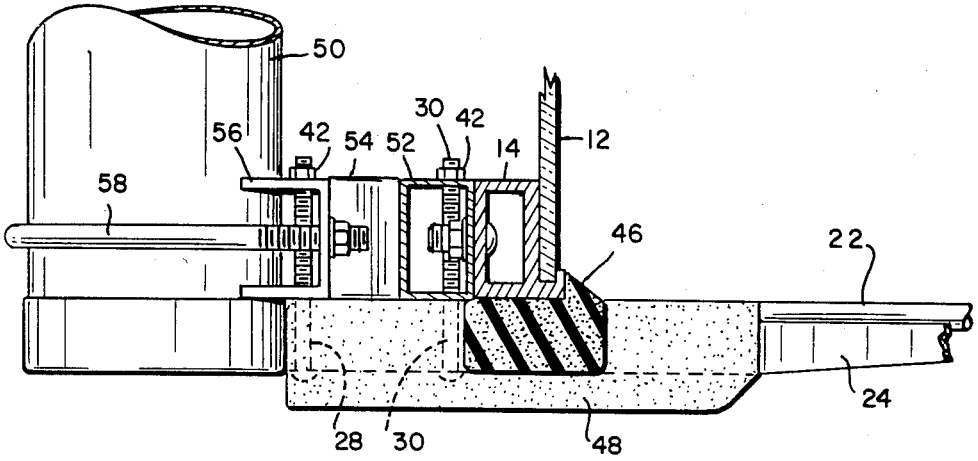
FIG. 4 is a cross-sectional side view of a backboard assembly of the present invention in combination with a centered vertical support structure.
Figure 5:
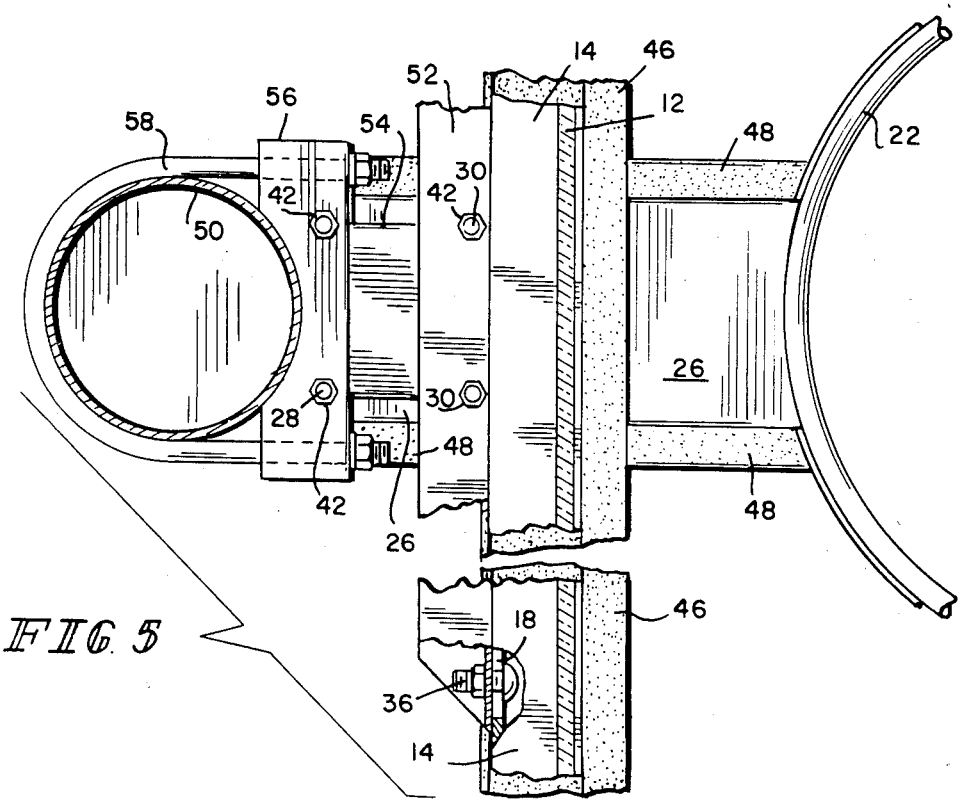
FIG. 5 is a plan view of the embodiment of FIG. 4.

In another embodiment of the present invention as illustrated in FIGS. 4 and 5, the backboard and goal are mounted to and supported by a single centered ceiling suspended post 50. In lieu of the vertical strut 34 and flange 38, the embodiment of FIGS. 4 and 5 include a horizontal brace 52 extending along a substantial portion of the back rear face of the bottom of the frame 14 and is secured in keyhole openings 18 by fasteners 36. The brace 52 is preferably tubular for strength and rigidity. A rectangular tubular element 54 connects the brace 52 to a U-shaped post clamp 56. A U-shaped bolt 58 is received in post clamp 56 and clamps the backboard to the post 50. The goal support 26 extending below the bottom edge of the frame 14 substantially to the post 50. Apertures 28 and 30 align with corresponding apertures in the clamp 56 and the horizontal brace 52 respectively and is secured thereto by fasteners 42. Thus, as in the previous embodiment, the embodiment of FIGS. 4 and 5 secure the goal support bracket 26 to the extended frame structure at two positions longitudinally spaced and transmitting forces evenly thereto.

Figure 6:
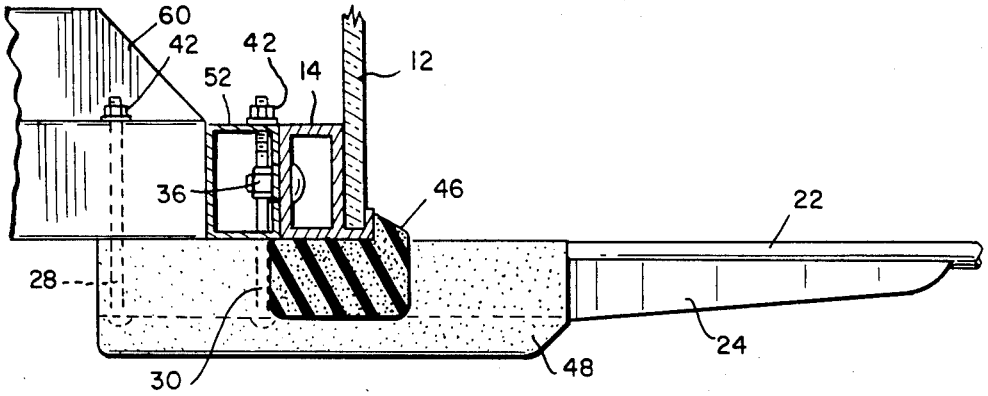
FIG. 6 is a side view of a basketball system incorporating the principles of the present invention connected to a centered horizontal strut support system.
Figure 7:
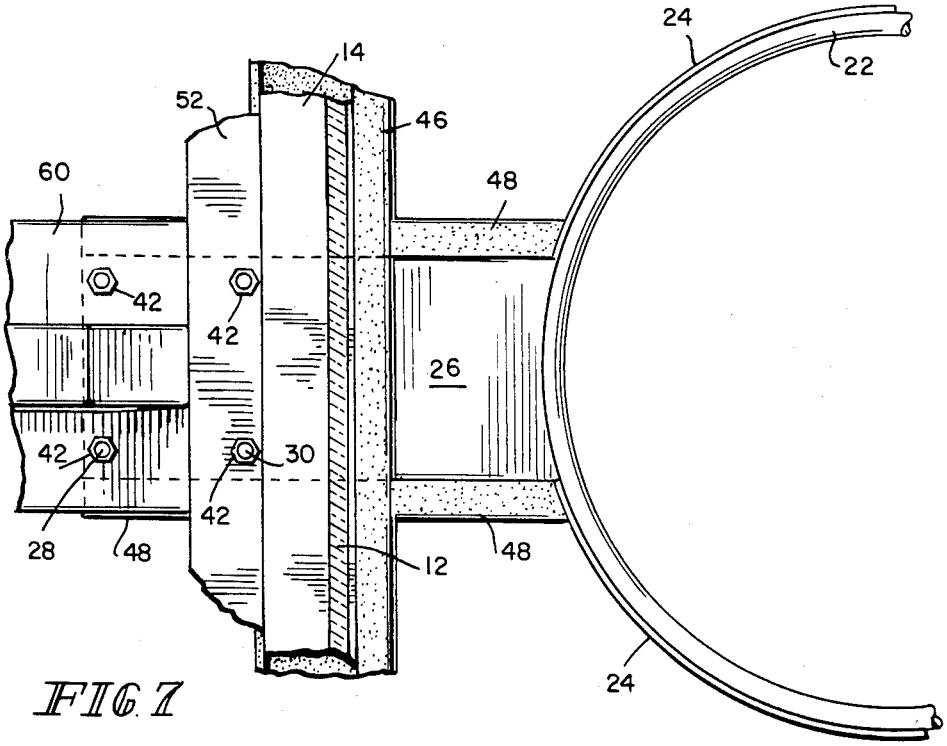
FIG. 7 is a plan view of the embodiment of FIG. 6.

Another embodiment as illustrated in FIGS. 6 and 7 is for mounting to a horizontally extending strut 60. Typically, this design is used in portable units or other floor or base mounted units. The strut 60 extends substantially perpendicular to the plane of the backboard. The extended backboard frame structure includes merely the horizontal brace 52 secured to the frame 14 by fasteners 36 in keyhole slots 18. The goal support bracket 26 extends beneath the bottom edge of the goal and along horizontal brace 52 and a portion of strut 60. The pairs of longitudinally spaced apertures 28 and 30 of the goal support bracket 26 align with openings and are secured by fasteners 42 to the strut 60 and the horizontal brace 52 respectively. Thus, as in the previous ebodiments, the forces experienced by the cantilevered goal are transferred to the extended backboard frame and support structure at a minimum of two longitudinally spaced positions.

Although the previously described embodiments provide an improved direct mount system, they are not designed to protect the player during a slam dunk.

Figure 8:
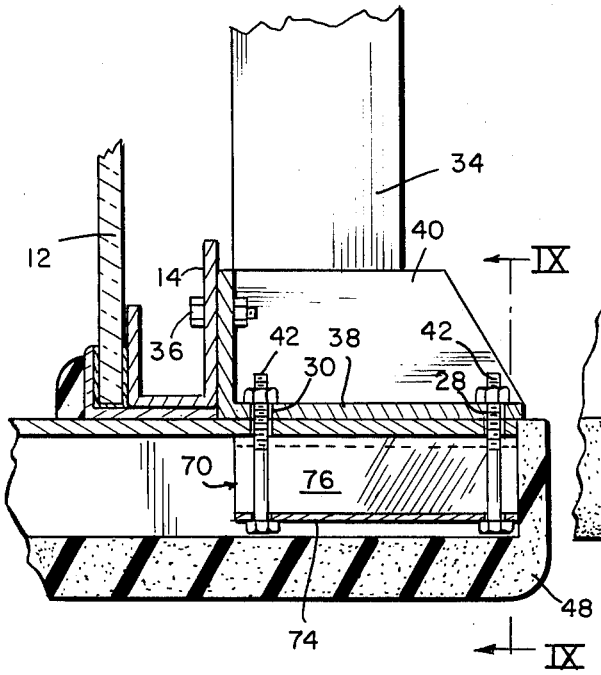
FIG. 8 is a cut-away cross sectional view of a first embodiment of a yieldable mounting according to principles of the present invention.
Figure 9:
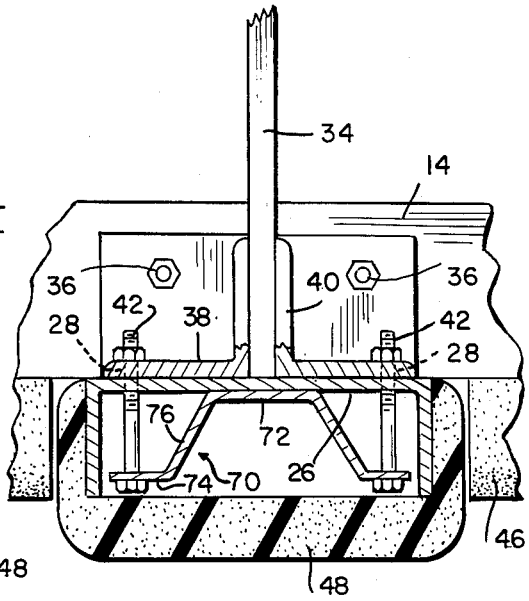
FIG. 9 is a cross-sectional view taken along lines IX—IX of FIG. 8.

To yieldably mount the goal to the frame, a resilient device 70 is provided on the fasteners 42 as illustrated in FIGS. 8 and 9. The resilient device 70 is a leaf spring having offset planar portion 72 and 74 contacting the mounting bracket 26 and the fasteners 43 respectively. A inclined portion 76 connects the two offset planar portion 72 and 74. A single metal leaf spring 70 is used for all four fasteners 42.

The mounting brackets 26 has been modified from the previous figures with the lower surface removed such as it has a U-shaped cross section. This allows access to the interior such that the resilient device 70 may be mounted therein. The padding 48 extends across and closes the open end of the bracket 26. The padding 48 is removable to allow acess to the resilient means for assembly/disassembly as well as adjustment. The apertures 28 and 30 are enlarged compared to the diameter of the fasteners 42 such that they may pivot relative thereto. This will allow varying amounts of deflection at each of the apertures due to the load on the rim.

It should be noted that the resilient device 70 should be sufficiently stiff to meet the NCAA standard for yieldable goals, namely the yieldable goal should have identical rebound characteristics as standard rigid type goals.

Figure 10:
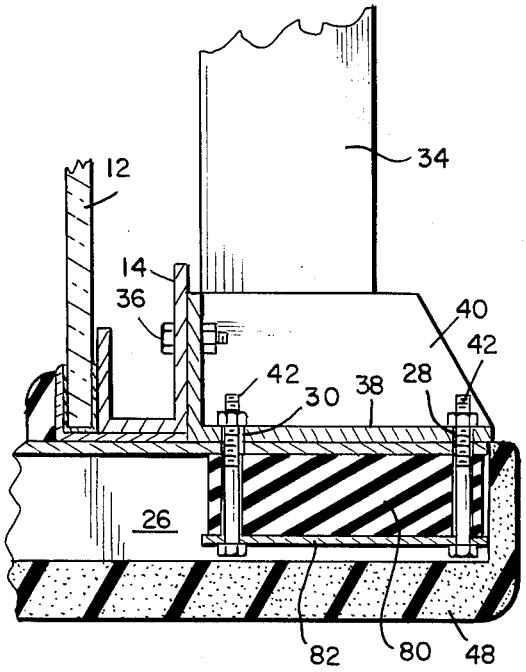
FIG. 10 is a cut-away cross sectional view of a second embodiment of a yieldable mounting according to principles of the present invention.

Another type of resilient element is illustrated in FIG. 10 as an elastomeric 80 connected to all four of the fasteners 42. Plate 82 separates the head of the fasteners 42 from the elastomer 80. The deformation of the elastomeric should meet the requirements described above.

Figure 11:
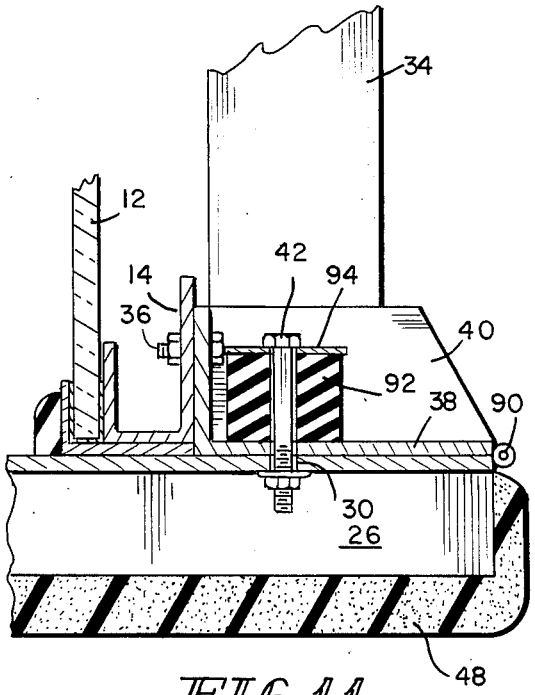
FIG. 11 is a cut-away cross sectional view of a third embodiment of a yieldable mounting according to principles of the present invention.

Another alternative, as illustrated in FIG. 11, provides a hinge 90 secured to the bracket between the flange 38 and the top wall of the support bracket 26. This defines one of the two laterally spaced positions. Elastomeric 92 with plate 94 is secured by fastener 42 at the second longitudinal space position. As illustrated in FIG. 11, since the elastomeric 92 is mounted outside the support bracket 26, individual elastomerics 92 are mounted to each of the fasteners 42.

Although a common resilient element is illustrated in FIGS. 8–9, individual resilient elements may be provided on the individual fasteners 42 interior the support brackt 26 as illustrated in FIGS. 8–10 or exterior as illustrated in FIG. 11. Although a leaf spring has been illustrated in FIGS. 8 and 9 and elastomer shown in FIGS. 10 and 11, other type of resilient elements may be used as long as they meet the requirement described above.

From the preceding description of the preferred embodiments, it is evident that the objects of the invention are attained. Although the invention has been described and illustrated with respect to three specific support structures, the present invention may be used with other support structures. The spirit and scope of the invention are to be limited only by the terms of the appended claims.

What is claimed is:

1. In a basketball system including a backboard and frame, a support to which said backboard is mounted, a goal, the improvement comprising:

first means connected to the rear bottom portion of said frame for extending the depth of the frame at the center thereof;

second means unitary with said goal extending along its longitudinal axis from said goal in front of said backboard to said first means in back of said backboard and traversing the bottom edge of said frame; and third means for yieldably securing said second means to said combined first means and frame at two longitudinally spaced positions, whereby said goal moves relative to said backboard in response to excessive downward force on said goal.

2. A basketball system according to claim 1, wherein said third means yieldably secures said second means to said first means at two longitudinally spaced pairs of points.

3. A basketball system according to claim 2, wherein said third means including a fastener and resilient means at each of said two spaced pairs of points.

4. A basketball system according to claim 3, including a common resilient means at all of said points.

5. A basketball system according to claim 1, wherein said third means includes a hinge having a horizontal axis of rotation at one of said positions and a fastener means and resilient means at the other position.

6. A basketball system according to claim 1, wherein said second means is a rectangular tube and said third means include a fastener means and a resilient means in said rectangular tube.

7. A basketball system according to claim 6, wherein said tube includes a rigid U-shaped cross-section and padding across the open end of the U-shape and extending along the outside of the legs of the U-shape.

8. A basketball system according to claim 7, wherein said padding is removably attached to said tube.

9. A basketball system according to claim 1, wherein said third means includes a fastener means and resilient means at each of said positions.

10. A basketball system according to claim 9, including a common resilient means at all of said positions.

11. A basketball system according to claim 10, wherein said resilient means is an elastomeric.

12. A basketball system according to claim 10, wherein said resilient means is a metal leaf spring.

13. A basketball system according to claim 1, wherein said first means includes a vertical brace secured to the top and bottom portions of said frame and centered thereon, and a horizontal flange on the bottom of said brace; and wherein said third means yieldably secures said second means to said horizontal flange.

* * * * *